US007988434B2

(12) United States Patent
Stover et al.

(10) Patent No.: US 7,988,434 B2
(45) Date of Patent: Aug. 2, 2011

(54) COMPRESSOR HAVING CAPACITY MODULATION SYSTEM

(75) Inventors: Robert C. Stover, Versailles, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 12/993,207

(22) PCT Filed: May 29, 2009

(86) PCT No.: PCT/US2009/045630

§ 371 (c)(1),
(2), (4) Date: Nov. 17, 2010

(87) PCT Pub. No.: WO2009/155091

PCT Pub. Date: Dec. 23, 2009

(65) Prior Publication Data

US 2011/0103988 A1 May 5, 2011

Related U.S. Application Data

(60) Provisional application No. 61/057,425, filed on May 30, 2008.

(51) Int. Cl.
*F04C 2/00* (2006.01)

(52) U.S. Cl. ..... 418/55.5; 418/15; 418/57; 418/180; 417/310; 417/308; 417/299

(58) Field of Classification Search ..... 418/15, 418/55.1–55.6, 57, 104, 180, 270; 417/299, 417/307, 308, 310, 440
See application file for complete search history.

(56) References Cited

U.S. PATENT DOCUMENTS

| | | | | |
|---|---|---|---|---|
| 4,431,388 | A | 2/1984 | Eber et al. | |
| 5,613,841 | A * | 3/1997 | Bass et al. | 418/55.5 |
| 6,123,517 | A | 9/2000 | Brooke et al. | |
| 6,176,686 | B1 * | 1/2001 | Wallis et al. | 417/310 |
| 6,293,767 | B1 * | 9/2001 | Bass | 417/310 |
| 6,350,111 | B1 | 2/2002 | Perevozchikov et al. | |
| 7,547,202 | B2 * | 6/2009 | Knapke | 418/55.5 |
| 7,717,687 | B2 * | 5/2010 | Reinhart | 418/55.5 |
| 2007/0036661 | A1 * | 2/2007 | Stover | 417/310 |
| 2009/0068048 | A1 * | 3/2009 | Stover et al. | 418/55.4 |
| 2009/0071183 | A1 * | 3/2009 | Stover et al. | 418/55.1 |
| 2009/0297377 | A1 * | 12/2009 | Stover et al. | 418/55.1 |
| 2009/0297378 | A1 * | 12/2009 | Stover et al. | 418/55.1 |
| 2009/0297379 | A1 * | 12/2009 | Stover et al. | 418/55.1 |
| 2009/0297380 | A1 * | 12/2009 | Stover et al. | 418/55.2 |
| 2010/0135836 | A1 * | 6/2010 | Stover et al. | 418/55.2 |
| 2010/0158731 | A1 * | 6/2010 | Akei et al. | 418/55.2 |
| 2010/0300659 | A1 * | 12/2010 | Stover et al. | 418/55.1 |
| 2010/0303659 | A1 * | 12/2010 | Stover et al. | 418/55.1 |

* cited by examiner

*Primary Examiner* — Theresa Trieu
(74) *Attorney, Agent, or Firm* — Harness, Dickey & Pierce, P.L.C.

(57) ABSTRACT

A compressor may include a housing and first and second scroll members supported within the housing, each having an end plate with a spiral wrap extending therefrom and meshingly engaged with the other to form a series of compression pockets operating at an intermediate fluid pressure between a suction pressure and a discharge pressure. A first passage in communication with one of the compression pockets extends from a first side of the first end plate to a second side of the first end plate generally opposite the first side. A modulation plate overlies the second side of the first scroll member for radial displacement between first and second positions. The modulation plate isolates the first passage from communication with a suction pressure region of the compressor when in the first position and provides communication between the first passage and the suction pressure region when in the second position.

24 Claims, 6 Drawing Sheets

COMPRESSOR HAVING CAPACITY MODULATION SYSTEM

CROSS-REFERENCE TO RELATED APPLICATIONS

This application claims the benefit of U.S. Provisional Application No. 61/057,425, filed on May 30, 2008. The entire disclosure of the above application is incorporated herein by reference.

FIELD

The present disclosure relates to compressors, and more specifically to compressors having capacity modulation systems.

BACKGROUND

This section provides background information related to the present disclosure which is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compressor.

SUMMARY

This section provides a general summary of the disclosure, and is not a comprehensive disclosure of its full scope or all of its features.

A compressor may include a housing and first scroll member supported within the housing and having a first end plate with a first spiral wrap extending from a first side of the first end plate. The second scroll member may be supported within the housing and may include a second end plate having a second spiral wrap extending therefrom and meshingly engaged with the first spiral wrap to form a series of compression pockets operating at an intermediate fluid pressure between a suction pressure and a discharge pressure. A first passage may be in communication with one of the compression pockets and extend from the first side of the first end plate to a second side of the first end plate generally opposite the first side. The modulation plate may overly the second side of the first scroll member and be secured within the housing for radial displacement between first and second positions. The modulation plate may isolate the first passage from communication with a suction pressure region of the compressor when in the first position and provide communication between the first passage and the suction pressure region when in the second position.

The compressor modulation plate may slide along the second side of the first end plate during displacement from the first position to the second position.

The compressor modulation plate may be pivotally coupled within the housing to a structure that is fixed relative to the first scroll member.

The compressor modulation plate may be pivotally coupled to the first scroll member.

The compressor may include an actuation mechanism engaged with the modulation plate to displace the modulation plate between the first and second positions.

The compressor may include a first scroll member defining a first recess housing the modulation plate therein and being in communication with the first passage and the suction pressure region.

The compressor may include a seal assembly engaged with the housing and isolating the suction pressure region of the compressor from a discharge pressure region of the compressor. A seal assembly and the first scroll member may define a second recess.

The compressor may include a first recess that is isolated from the second recess.

The compressor may include a first recess that is located axially between the second side of the first end plate and the second recess.

The compressor modulation plate may include an aperture in communication with the first passage when the modulation plate is in the first position.

The compressor modulation plate may include first and second surfaces generally opposite one another. A first surface may have a recess extending therein and defining a first radial surface area. The aperture may extend through the first and second surfaces and provide communication between the recess and the first passage when the modulation plate is in the first position. A second surface may define a second radial surface area exposed to the first passage when the modulation plate is in the first position. The second radial surface area may be approximately equal to the first radial surface area.

The compressor may include a recess that includes a seal to prevent communication between the suction pressure region and the recess when the modulation plate is in the first position.

The compressor may include a spring disposed within the recess of the modulation plate to axially bias the seal against the first scroll member.

The compressor may include a first passage that has a generally arcuate shape having an angular extent of at least twenty degrees.

A compressor may include a housing and a first scroll member supported within the housing and having a first end plate with a first spiral wrap extending from a first side of said first end plate. A second scroll member may be supported within the housing and include a second end plate having a second spiral wrap extending therefrom and meshingly engaged with the first spiral wrap to form a series of compression pockets operating at an intermediate fluid pressure between a suction pressure and a discharge pressure. A first passage may be in communication with one of the compressor pockets and extend from the first side of the first end plate to a second side of the first end plate generally opposite the first side. The seal assembly may be engaged with the housing and the first scroll member and define an axial biasing chamber in communication with a first of the compression pockets. The modulation plate may overly the second side of the first scroll member and be located axially between the axial biasing chamber and the compression pockets and within an outer perimeter of the axial biasing chamber. The modulation plate may be secured within the housing for radial displacement between the first and second positions. The modulation plate may isolate the first passage from communication with a suction pressure region of the compressor when in the first position and provide communication between the first passage and the suction pressure region when in the second position.

The compressor modulation plate may include an annular body defining a central opening and the first scroll member includes an annular hub extending through the central opening.

The compressor modulation plate may include a pivot mount having a pivot pin extending therethrough and pivotally coupling the modulation plate within the housing to a structure that is fixed relative to the first scroll member.

The compressor may include of an actuation mechanism. The modulation plate may include an arm extending radially outward from the annular body and coupled to the actuation mechanism.

The compressor actuation mechanism may pivot the modulation plate about the pivot pin.

The compressor modulation plate may slide along the second side of the first end plate during displacement from the first position to the second position.

The compressor modulation plate may include an aperture in communication with the first passage when the modulation plate is in the first position.

The compressor modulation plate may include a first and second surface generally opposite one another. The first surface may have a recess extending therein and defining a first radial surface area. The aperture may extend through the first and second surfaces and provide communication between the recess and the first passage when the modulation plate is in the first position. The second surface may define a second radial surface area exposed to the first passage when the modulation plate is in the first position. The second radial surface area may be approximately equal to the first radial surface area.

The compressor recess may include a seal to prevent communication between the suction pressure region and the recess when the modulation plate is in the first position.

The compressor may include a spring disposed within the recess of the modulation plate to axially bias the seal against the first scroll member.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
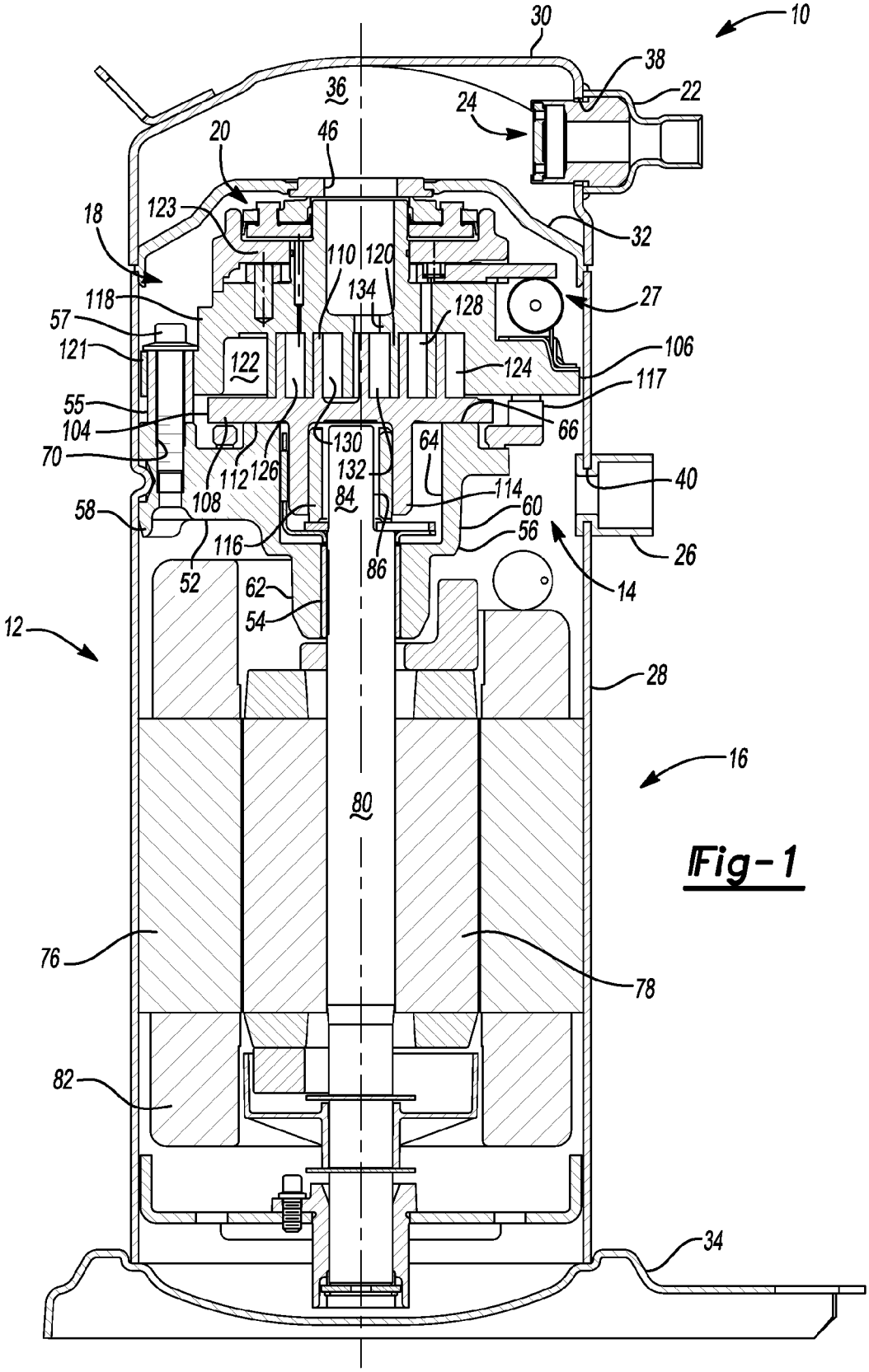
FIG. 1 is a section view of a compressor according to the present disclosure.
Figure 2:
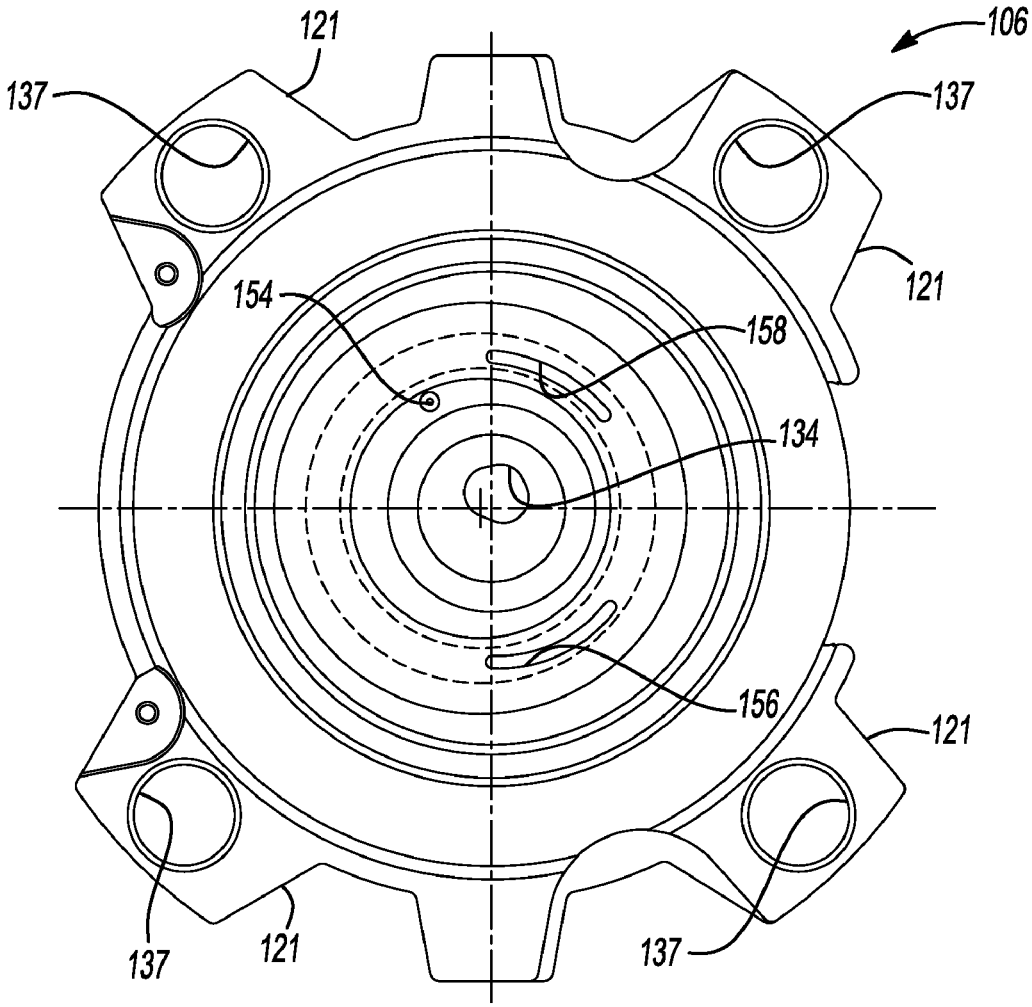
FIG. 2 is a plan view of a non-orbiting scroll member of the compressor of FIG. 1.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 46 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arms 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

With additional reference to FIGS. 2-4, 6 and 7, non-orbiting scroll 106 may include an end plate 118 having a spiral wrap 120 on a lower surface thereof, a series of radially outwardly extending flanged portions 121, and a plate member 123. Spiral wrap 120 may form a meshing engagement with wrap 110 of orbiting scroll 104, thereby creating a series of pockets 122, 124, 126, 128, 130, 132. Non-orbiting scroll 106 may be axially displaceable relative to main bearing housing assembly 14, shell assembly 12, and orbiting scroll 104. Non-orbiting scroll 106 may include a discharge passage 134 in communication with pocket 132 and in fluid communication with discharge chamber 36 via discharge passage 46 in partition 32.

Flanged portions 121 may include openings 137 therethrough. Opening 137 may receive bushings 55 therein and bushings 55 may receive fasteners 57. Fasteners 57 may be engaged with main bearing housing 52 and bushings 55 may generally form a guide for axial displacement of non-orbiting scroll 106. Fasteners 57 may additionally prevent rotation of non-orbiting scroll 106 relative to main bearing housing assembly 14.

Figure 6:
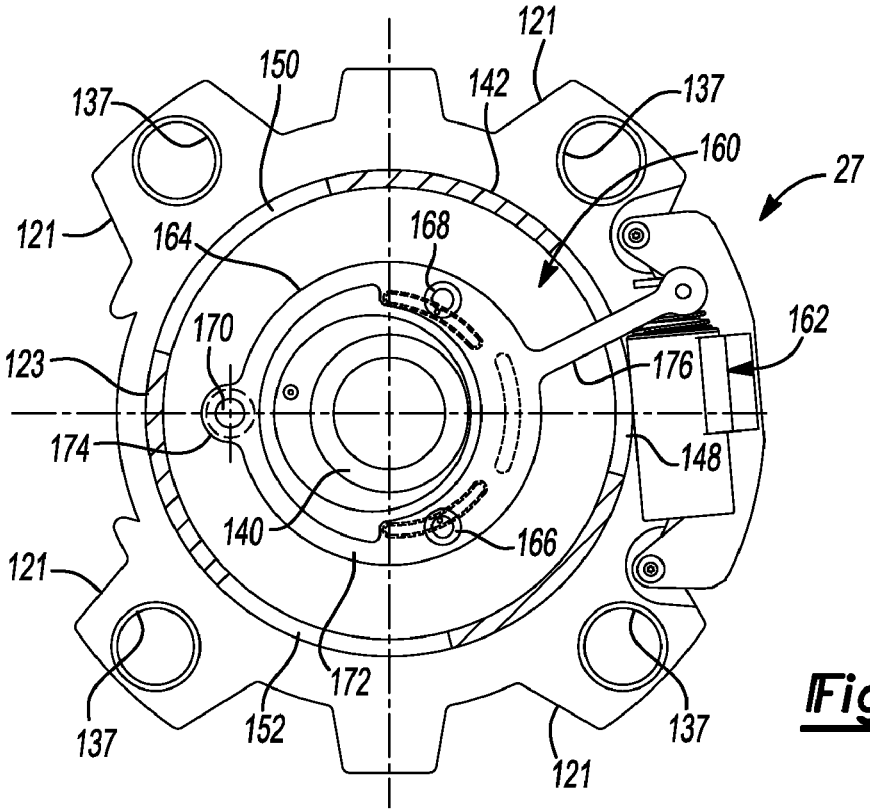
FIG. 6 is a plan view of the non-orbiting scroll and modulation system of FIG. 3.
Figure 7:
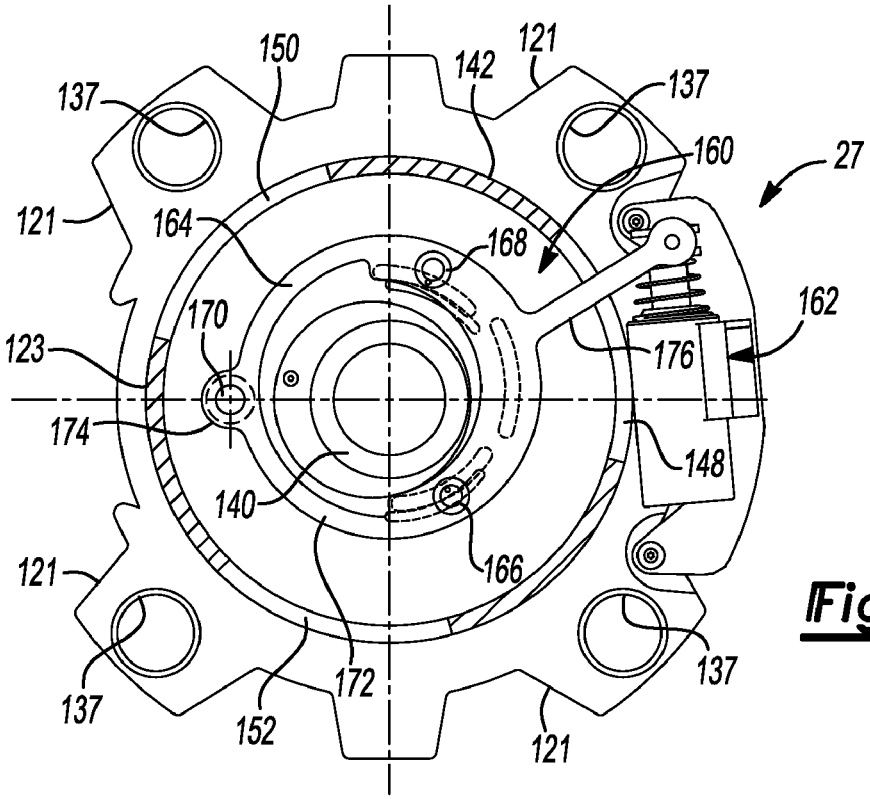
FIG. 7 is an additional plan view of the non-orbiting scroll and modulation system of FIG. 6.

End plate 118 may include an inner side wall 140 defining an annular hub surrounding discharge passage 134. Plate member 123 may include an outer side wall 142 generally parallel to and coaxial with inner side wall 140. Plate member 123 may be fixed to end plate 118 and may cooperate with end plate 118 to form first and second annular recesses 144, 146. As seen in FIGS. 6 and 7, plate member 123 may include openings 148, 150, 152 through outer side wall 142 providing communication between second annular recess 146 and a suction pressure region of compressor 10.

First and second annular recesses 144, 146 may be isolated from one another. First annular recess 144 may provide for axial biasing of non-orbiting scroll 106 relative to orbiting scroll 104. More specifically, a passage 154 may extend through end plate 118 of non-orbiting scroll 106, placing first annular recess 144 in fluid communication with one of pockets 122, 124, 126, 128, 130 operating at an intermediate fluid pressure. Additional passages 156, 158 may extend through end plate 118, placing second annular recess 146 in communication with two or more of pockets 122, 124, 126, 128, 130 operating at an intermediate fluid pressure. Passages 156, 158 may have an arcuate form having an angular extent of at least twenty degrees. Second annular recess 146 may be in communication with different ones of pockets 122, 124, 126, 128, 130 than first annular recess 144. More specifically, second annular recess 146 may be in communication with two or more of pockets 122, 124, 126, 128, 130 located radially outwardly relative to the pocket 122, 124, 126, 128, 130 in communication with the first annular recess 144. Therefore, first annular recess 144 may operate at a pressure greater than an operating pressure of second annular recess 146.

Seal assembly 20 may include a floating seal located within first annular recess 144 forming an axial biasing chamber. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. More specifically, pressure within first annular recess 144 may bias seal assembly 20 into engagement with partition 32 during normal compressor operation.

Figure 8:
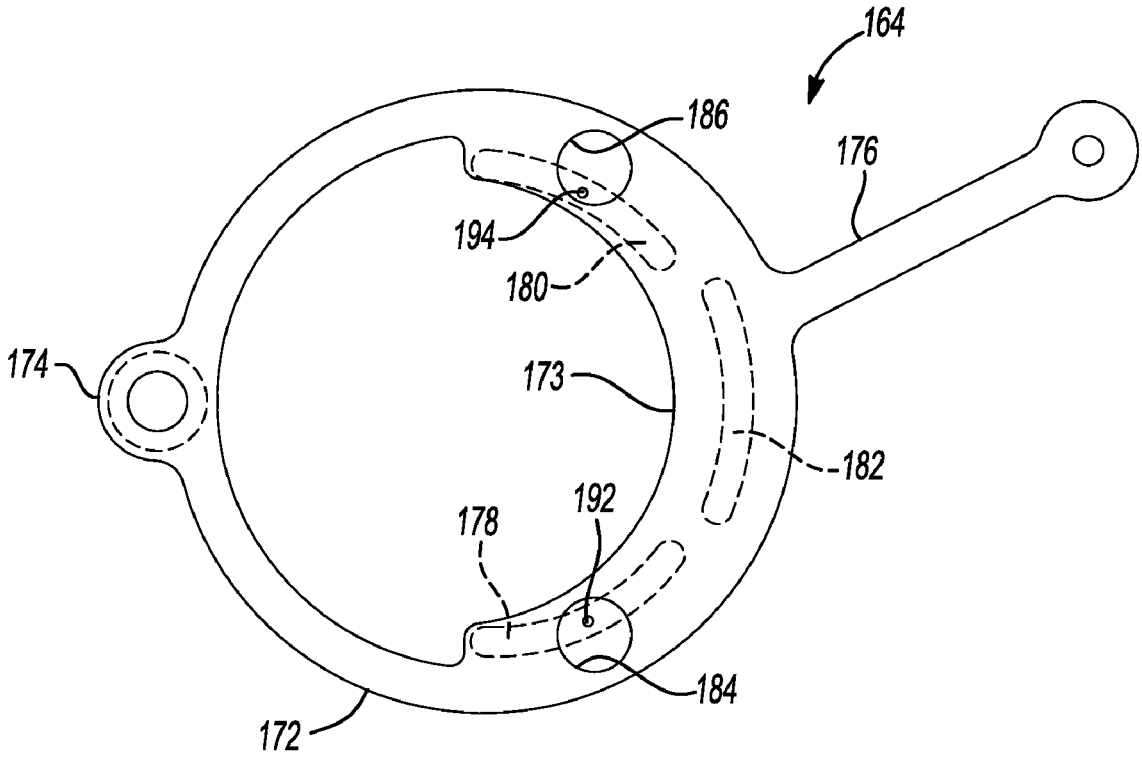
FIG. 8 is a plan view of a portion of the modulation system of FIG. 3.

Modulation assembly 27 may include a modulation plate assembly 160 and an actuation mechanism 162. Modulation plate assembly 160 may include a modulation plate 164, first and second seals 166, 168, and a pivot pin 170. With additional reference to FIG. 8, modulation plate 164 may include a generally circular main body 172 defining a central opening 173 and having a pivot mount 174 and an arm 176 extending radially outward therefrom, and a series of protrusions 178, 180, 182 extending axially outward from a lower surface thereof. Inner side wall (or annular hub) 140 may extend through central opening 173. Protrusions 178, 180 may have a shape generally conforming to the shape of passages 156, 158, but having a greater width and angular extent than passages 156, 158. First and second recesses 184, 186 may extend axially into an upper surface of main body 172 at a location above a portion of first and second protrusions 178, 180.

Figure 3:
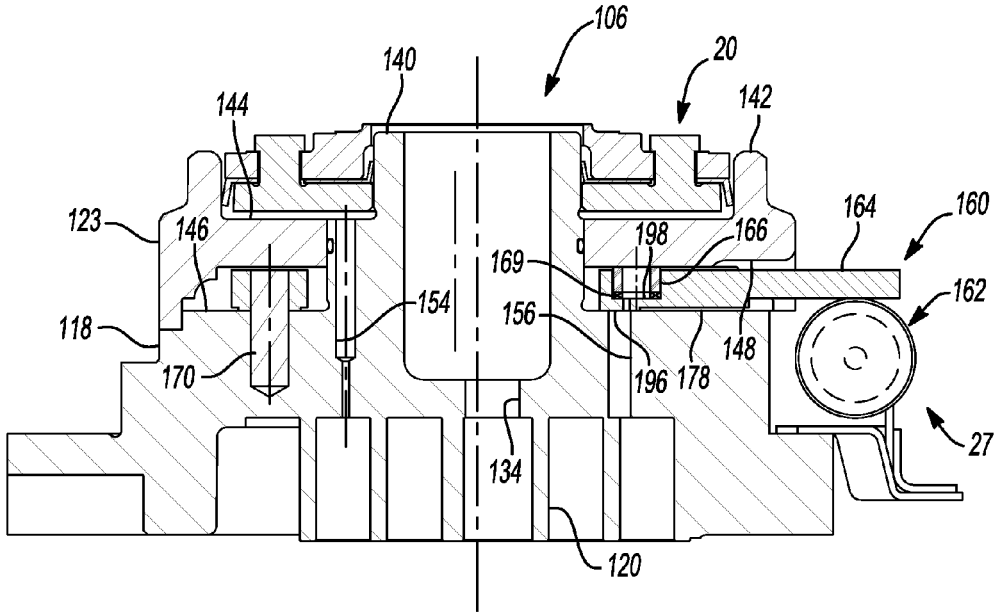
FIG. 3 is a section view of a non-orbiting scroll, seal assembly, and modulation system of the compressor of FIG. 1.
Figure 4:
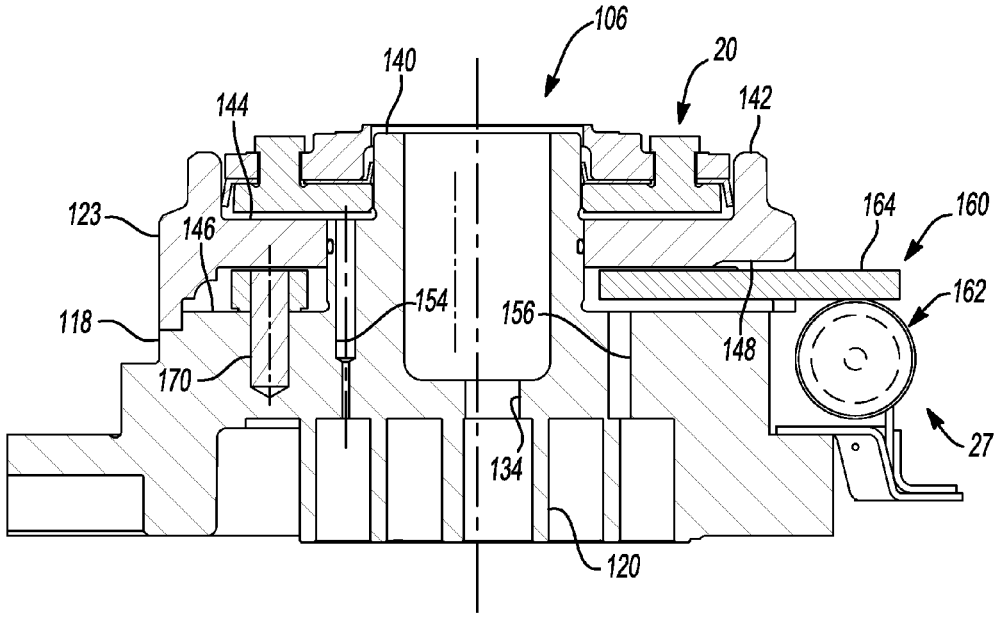
FIG. 4 is an additional section view of the non-orbiting scroll, seal assembly, and modulation system of FIG. 3.

A first aperture 192 may be located in first recess 184 and extend through protrusion 178 and a second aperture 194 may be located in second recess 186 and may extend through second protrusion 180. First seal 166 may be located within first recess 184 and second seal 168 may be located within second recess 186. As seen in FIGS. 3 and 4, first and second seals 166, 168 may have generally annular bodies. Additionally, biasing members 169 may be engaged with first and second seals 166, 168 to urge first and second seals 166, 168 into engagement with plate member 123 and isolate first and second recesses 184, 186 from the suction pressure region of compressor 10.

Figure 5:
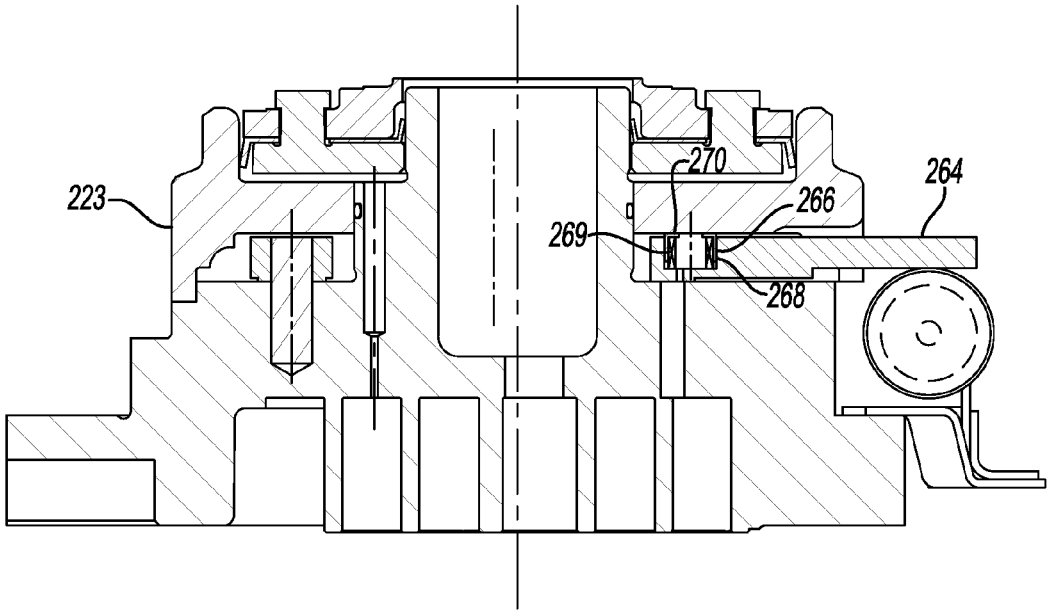
FIG. 5 is a section view of an alternate non-orbiting scroll, seal assembly, and modulation system according to the present disclosure.

Alternatively, as seen in FIG. 5, first and second seals 166, 168 may be replaced with seal 266. Seal 266 may include an axial extending portion 268 and a radially extending portion 270. Axial extending portion 268 may be engaged with modulation plate 264 and radially extending portion 270 may be engaged with plate member 223. Biasing members 269 may be engaged with modulation plate 264 and radially extending portion 270 to bias seal 266 against plate member 223.

Referring back to FIGS. 3, 4, 6 and 7, modulation plate 164 may overly an upper surface of end plate 118 and may be pivotally coupled within shell assembly 12 at pivot mount 174. Pivot pin 170 may extend through pivot mount 174 and may be fixed relative to non-orbiting scroll 106. More specifically, pivot pin 170 may extend into end plate 118 of non-orbiting scroll 106 and be fixed thereto. As such, modulation plate 164 may be slidable along the upper surface of end plate 118. The upper surface of end plate 118 may generally form an axial end surface of modulation plate 164.

Actuation mechanism 162 may be coupled to arm 176 of modulation plate 164 and may displace modulation plate 164 between first and second positions. Actuation mechanism 162 may form a linear actuator. The displacement between the first and second positions may include modulation plate 164 being slid radially along the upper surface of end plate 118.

In the first position (FIGS. 3 and 6), protrusion 178 may overly and seal passage 156 and protrusion 180 may overly and seal passage 158, isolating passages 156, 158 from communication with the suction pressure region of compressor 10. When modulation plate 164 is in the first position, first aperture 192 may provide communication between passage 156 and first recess 184 and second aperture 194 may provide communication between passage 158 and second recess 186. As indicated above, first and second seals 166, 168 may isolate first and second recesses 184, 186 from communication with the suction pressure region. First and second recesses 184, 186 may be sized to balance a force applied to protrusions 178, 180 of modulation plate 164 by the pressurized fluid from passages 156, 158.

For simplicity, first recess 184 and protrusion 178 will be discussed with the understanding that the description applies equally to second recess 186 and protrusion 180. Protrusion 178 may have a lower axial surface 196 exposed to passage 156 and first recess 184 may include an upper axial surface 198 exposed to pressurized fluid within first recess 184 provided by passage 156. Therefore, the pressure applied to upper and lower axial surfaces 196, 198 may be generally the same. Lower axial surface 196 may have a first radially extending surface area exposed to the pressurized fluid from passage 156 and upper axial surface 198 may have a second radially extending surface area exposed to the pressurized fluid. The first and second radially extending surface areas may be generally similar to one another, balancing the axial force applied on modulation plate 164 from the pressurized fluid and the axial force applied to modulation plate 164 by biasing members 169.

In the second position (FIGS. 4 and 7), protrusions 178, 180 may be displaced radially from passages 156, 158, providing communication between passages 156, 158 and the suction pressure region of compressor 10 via openings 148, 150, 152. When modulation plate 164 is in the second position, capacity of compressor 10 may be reduced relative to the capacity of compressor 10 when modulation plate 164 is in the first position.

The terms "first", "second", etc. are used throughout the description for clarity only and are not intended to limit similar terms in the claims.

What is claimed is:

1. A compressor comprising:

a housing;

a first scroll member supported within said housing and including a first end plate, a first spiral wrap extending from a first side of said first end plate, and a first passage extending from said first side of said first end plate to a second side of said first end plate generally opposite said first side;

a second scroll member supported within said housing and including a second end plate having a second spiral wrap extending therefrom and meshingly engaged with said first spiral wrap to form a series of compression pockets operating at an intermediate fluid pressure between a suction pressure and a discharge pressure, said first passage being in communication with one of said compression pockets; and a modulation plate overlying said second side of said first scroll member and secured within said housing for radial displacement between first and second positions, said modulation plate isolating said first passage from communication with a suction pressure region of the compressor when in the first position and providing communication between said first passage and said suction pressure region when in the second position.

2. The compressor of claim 1, wherein said modulation plate slides along said second side of said first end plate during displacement from the first position to the second position.

3. The compressor of claim 1, wherein said modulation plate is pivotally coupled within said housing to a structure that is fixed relative to said first scroll member.

4. The compressor of claim 3, wherein said modulation plate is pivotally coupled to said first scroll member.

5. The compressor of claim 3, further comprising an actuation mechanism engaged with said modulation plate to displace said modulation plate between the first and second positions.

6. The compressor of claim 1, wherein said first scroll member defines a first recess housing said modulation plate therein and being in communication with said first passage and said suction pressure region.

7. The compressor of claim 6, further comprising a seal assembly engaged with said housing and isolating said suction pressure region of the compressor from a discharge pressure region of the compressor, said seal assembly and said first scroll member defining a second recess.

8. The compressor of claim 7, wherein said first recess is isolated from said second recess.

9. The compressor of claim 7, wherein said first recess is located axially between said second side of said first end plate and said second recess.

10. The compressor of claim 1, wherein said modulation plate includes an aperture in communication with said first passage when said modulation plate is in the first position.

11. The compressor of claim 10, wherein said modulation plate includes first and second surfaces generally opposite one another, said first surface having a recess extending therein and defining a first radial surface area, said aperture extending through said first and second surfaces providing communication between said recess and said first passage when said modulation plate is in the first position, said second surface defining a second radial surface area exposed to said first passage when said modulation plate is in the first position, said second radial surface area being approximately equal to said first radial surface area.

12. The compressor of claim 11, wherein said recess includes a seal to prevent communication between said suction pressure region and said recess when said modulation plate is in the first position.

13. The compressor of claim 12, further comprising a spring disposed within said recess of said modulation plate to axially bias said seal against said first scroll member.

14. The compressor of claim 1, wherein said first passage has a generally arcuate shape having an angular extent of at least 20 degrees.

15. A compressor comprising:

a housing, a first scroll member supported within said housing and including a first end plate, a first spiral wrap extending from a first side of said first end plate, and a first passage extending from said first side of said first end plate to a second side of said first end plate generally opposite said first side;

a second scroll member supported within said housing and including a second end plate having a second spiral wrap extending therefrom and meshingly engaged with said first spiral wrap to form a series of compression pockets operating at an intermediate fluid pressure between a suction pressure and a discharge pressure, said first passage being in communication with one of said compression pockets;

a seal assembly engaged with said housing and said first scroll member and defining an axial biasing chamber in communication with a first of said compression pockets; and a modulation plate overlying said second side of said first scroll member and located axially between said axial biasing chamber and said compression pockets and within an outer perimeter of said axial biasing chamber, said modulation plate secured within said housing for radial displacement between first and second positions, said modulation plate isolating said first passage from communication with a suction pressure region of the compressor when in the first position and providing communication between said first passage and said suction pressure region when in the second position.

16. The compressor of claim 15, wherein said modulation plate includes an annular body defining a central opening and said first scroll member includes an annular hub extending through said central opening.

17. The compressor of claim 16, wherein said modulation plate includes a pivot mount having a pivot pin extending therethrough and pivotally coupling said modulation plate within said housing to a structure that is fixed relative to said first scroll member.

18. The compressor of claim 17, further comprising an actuation mechanism, said modulation plate including an arm extending radially outward from said annular body and coupled to said actuation mechanism.

19. The compressor of claim 18, wherein said actuation mechanism pivots said modulation plate about said pivot pin.

20. The compressor of claim 19, wherein said modulation plate slides along said second side of said first end plate during displacement from the first position to the second position.

21. The compressor of claim 15, wherein said modulation plate includes an aperture in communication with said first passage when said modulation plate is in the first position.

22. The compressor of claim 21, wherein said modulation plate includes first and second surfaces generally opposite one another, said first surface having a recess extending therein and defining a first radial surface area, said aperture extending through said first and second surfaces providing communication between said recess and said first passage when said modulation plate is in the first position, said second surface defining a second radial surface area exposed to said first passage when said modulation plate is in the first position, said second radial surface area being approximately equal to said first radial surface area.

23. The compressor of claim 22, wherein said recess includes a seal to prevent communication between said suction pressure region and said recess when said modulation plate is in the first position.

24. The compressor of claim 23, further comprising a spring disposed within said recess of said modulation plate to axially bias said seal against said first scroll member.

* * * * *